US009214757B2

(12) United States Patent
Harkins

(10) Patent No.: US 9,214,757 B2
(45) Date of Patent: Dec. 15, 2015

(54) CONTAMINATION AVOIDANCE COMBINATION HIGH VOLTAGE INTERLOCK COVER

(71) Applicants: DENSO International America, Inc., Southfield, MI (US); DENSO CORPORATION, Kariya, Aichi-pref. (JP)

(72) Inventor: James Harkins, Canton, MI (US)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 14/105,725

(22) Filed: Dec. 13, 2013

(65) Prior Publication Data

US 2015/0171556 A1 Jun. 18, 2015

(51) Int. Cl.
*H01R 13/46* (2006.01)
*H01R 13/53* (2006.01)
*H01R 13/52* (2006.01)

(52) U.S. Cl.
CPC ..... *H01R 13/53* (2013.01); *H01R 13/5213* (2013.01); *H01R 2201/26* (2013.01)

(58) Field of Classification Search
CPC ..... H01R 2201/26; H01R 13/6397; H01R 13/5213; H01R 13/447; H01R 13/46
USPC ..... 439/76.2, 304
See application file for complete search history.

(56) References Cited

U.S. PATENT DOCUMENTS

2003/0089020 A1* 5/2003 Dirito ..... 43/17
2011/0034053 A1* 2/2011 Matsumoto ..... B60L 3/0069 439/304
2011/0287667 A1* 11/2011 Ichio ..... H01R 13/4367 439/660
2012/0083148 A1* 4/2012 Hirashita ..... B60L 11/1818 439/304
2012/0202365 A1* 8/2012 Ichio ..... B60L 11/1818 439/131
2013/0196522 A1* 8/2013 Hara ..... B60L 11/1818 439/136
2015/0037994 A1* 2/2015 Nakajima ..... H01R 13/6397 439/304

* cited by examiner

*Primary Examiner* — Truc Nguyen

(57) ABSTRACT

The present disclosure is directed towards a high voltage interface cover system for inhibiting liquid contamination of high voltage connection areas of EV's and HEV's. This liquid contamination may come from atmospheric precipitation or road splash which comes in contact with the surface of either the HVDC connection block cover and/or the high voltage main device cover, and flows into the interface seals connecting them. The cover system comprises a pair of interlocking covers which provide a tortuous path for liquid contamination to penetrate the interface.

6 Claims, 3 Drawing Sheets

CONTAMINATION AVOIDANCE COMBINATION HIGH VOLTAGE INTERLOCK COVER

This present disclosure relates to the field of electric vehicles (EV) or electric-hybrid vehicles (EHV). More specifically, this present disclosure relates to the High Voltage Direct Current (HVDC) connection system for an EV or EHV, particularly the High Voltage Interlock (HVIL) interface.

BACKGROUND

This section provides background information related to the present disclosure which is not necessarily prior art.

In HEV structures and EV structures, a breaker device and a high-voltage unit are placed in a space isolated from the occupant compartment and luggage compartment of the vehicle and the space is closed by covering it with a lid for maintenance. For maintenance and inspection of a high voltage device, an appropriate safety measure or measures must be taken to ensure that a person who performs maintenance and inspection of the HV device is sufficiently protected from high voltage. The interlock mechanism interrupts, for protection from high voltage, a corresponding circuit when a protection cover is detached. This concept is applicable towards any high voltage power electronic main device found in EV's and HEV's (such as a traction inverter, DCDC converter, onboard charge module, etc.)

Current designs generally have two configurations: (A) utilize the HVDC connection block cover independent from other covers on a high voltage power electronic device, or (B) utilize the HVDC cover and integrated HVIL to prevent secondary covers from being removed while device is under power.

The longstanding issue with both these designs is the allowance of a gap between the HVDC cover and the main device cover, which can allow fluid/contaminants to penetrate the HVDC interface. Contamination in this area may result in a high voltage short circuit, shock risk to persons, and even a vehicle thermal event.

SUMMARY

This section provides a general summary of the disclosure, and is not a comprehensive disclosure of its full scope or all of its features.

In light of the shortcomings in the prior art, the present disclosure is directed towards preventing liquid contamination of high voltage connection areas of EV's and HEV's. This liquid contamination may come from atmospheric precipitation or road splash which comes in contact with the surface of either the HVDC connection block cover and/or the high voltage main device cover, and flows into the interface seals connecting them.

In order to achieve this result, a new HV connection cover system design is disclosed. The particular cover system significantly inhibits liquid contamination from flowing into the electric interface seals connecting the HVDC connection block and the HV main device.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1A:
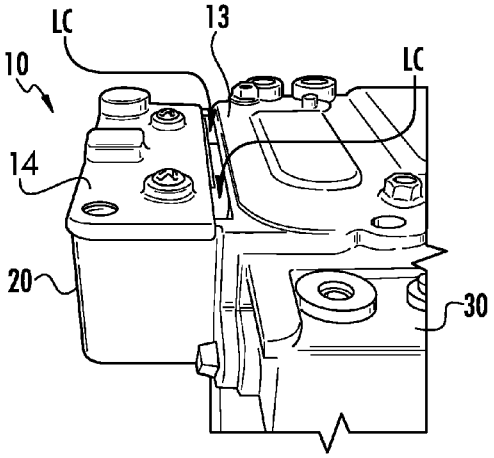
FIG. 1A (PRIOR ART)
FIG. 1A is a partial perspective view of a first prior art HV cover system.

Example embodiments will now be described more fully with reference to the accompanying drawings. The following description is merely exemplary in nature and is not intended to limit the present disclosure, application, or uses. It should be understood that throughout the drawings, corresponding reference numerals indicate like or corresponding parts and features.

Referring to the figures, in particularly FIGS. 1A-2B, prior art in this field will be described illustrating a high voltage cover system 10. In typical EV's and HEV's a HV connection block 20 is attached to any number of high voltage devices 30, such as traction inverters, DCDC converters, or onboard charge modules. The connection block 20 through an electrical interface 15, provides power from the vehicle's batteries (not shown) to the high voltage device 30.

In order to protect the HV connection block 20 and the associated HV device 30 from moisture and debris, both the connection block 20 and the HV device 30 employ a cover 14, 13 respectively. Even though the covers 14, 13 fit their respective components securely liquid contamination (LC) such as rain water, moisture, or other precipitation can run down into the joint between the connection block 20 and HV device 30. Some assurances are usually made in sealing the interface 15 to prevent moisture from entering, it is still a dangerous probability.

Figure 2A:
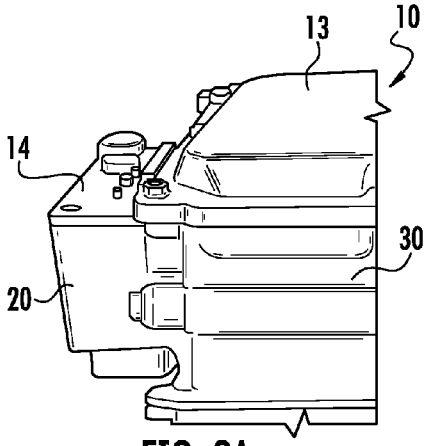
FIG. 2A (PRIOR ART)
FIG. 2A is a partial perspective view of a second prior art HV cover system.
Figure 1B:
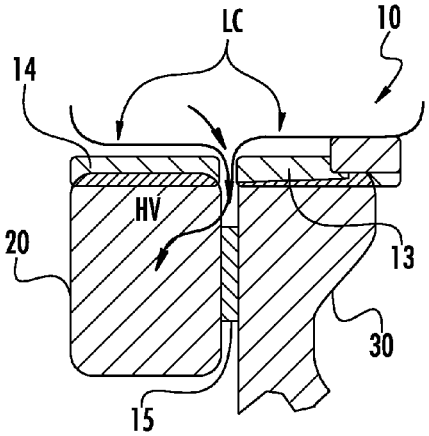
FIG. 1B (PRIOR ART)
FIG. 1B is a partial side view of the prior art HV cover system of FIG. 1A.
Figure 2B:
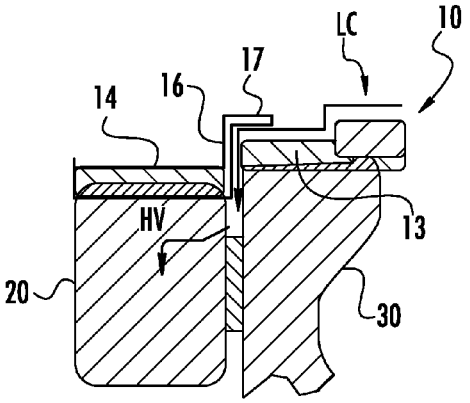
FIG. 2B (PRIOR ART)
FIG. 2B is a partial side view of the prior art HV cover system of FIG. 2A.
Figure 3A:
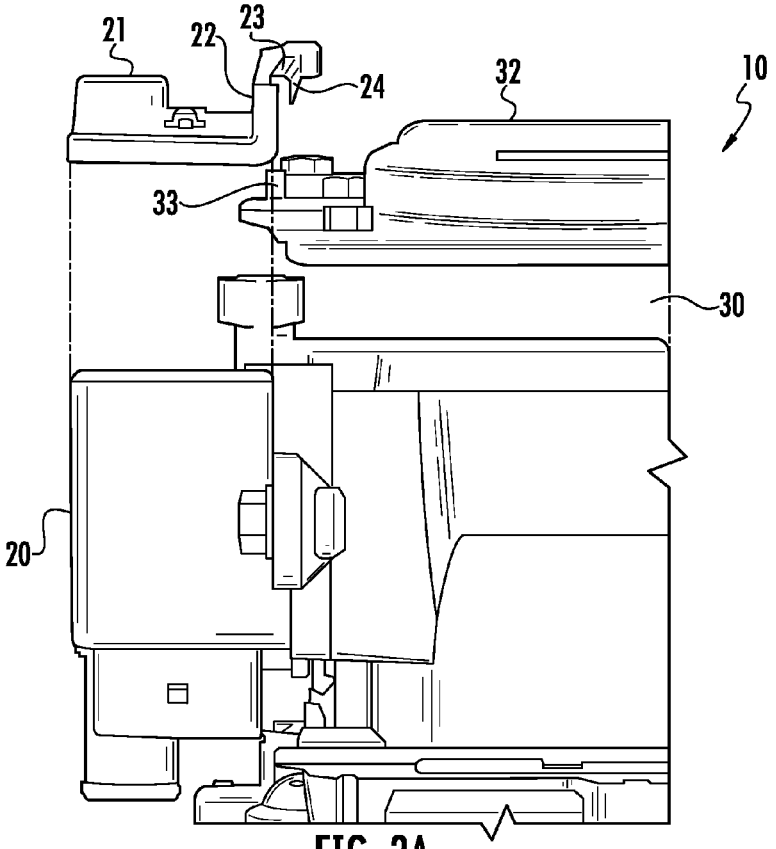
FIG. 3A is a perspective disassembled view representing the primary embodiment HV cover system of the present disclosure.
Figure 3B:
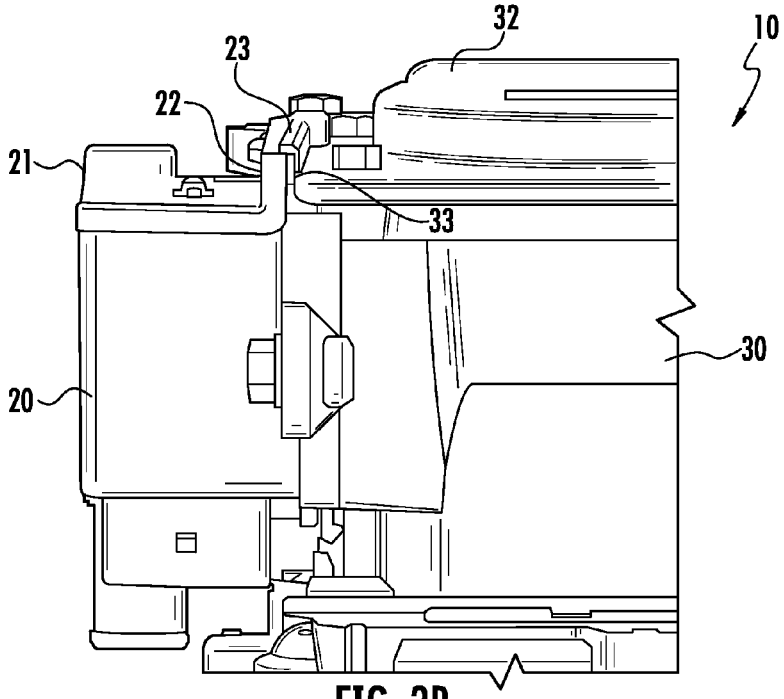
FIG. 3B is a perspective assembled view of the primary embodiment HV cover system in FIG. 3A.
Figure 4A:
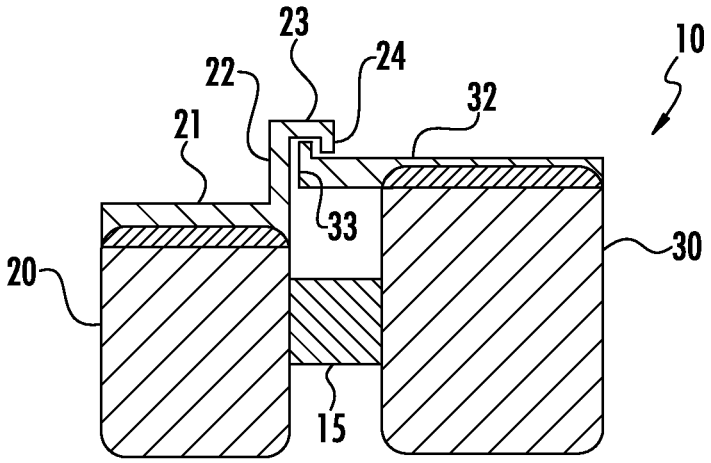
FIG. 4A is a is a partial side view of the HV cover system of FIG. 3B.
Figure 4B:
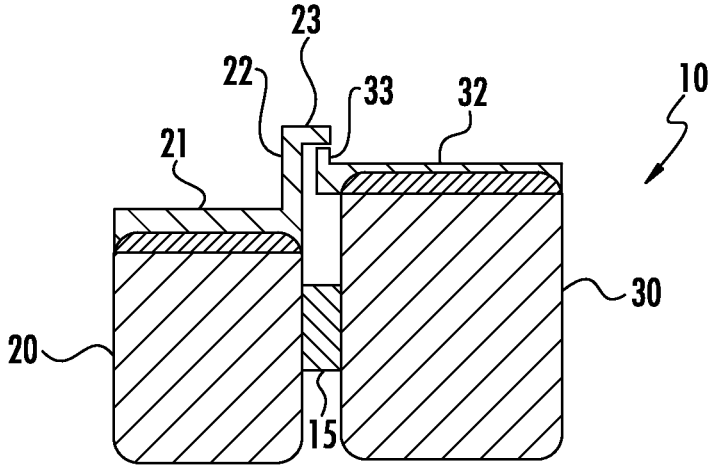
FIG. 4B is a partial side view of a secondary embodiment HV cover system.

FIGS. 2A & 2B illustrate an overlapping interlock cover arrangement in the prior art. In this arrangement cover 14 incorporates a raised wall 16 and a lip 17, generally parallel to the main cover 14 which partially overlaps the cover 13 for the HV device 30. This prevents the removal of cover 13 prior to the removal of cover 14, and provides some added protection against debris entering the interface 15, there is still the possibility of liquid contamination LC flowing into the interface and causing a shock, failure, or possibly fire.

Referring now to FIGS. 3A thru 4A, the preferred embodiment of the present cover system 10 is shown. As described in the prior art, the HV connection block 20 attached to a HV device 30, and provides an electrical interface there between. HV connector 20 is also provided a cover 21, which is attached to an upper side of the connection block 20 thru known fastening devices. The cover 21 partially overlaps around the vertical sides of the connection block 20 which provides the power supply from the vehicle's battery. Likewise, HV device 30 is also provided a cover 32, which is attached to an upper side of the HV device 30 thru known fastening devices. The cover 32 partially overlaps around the vertical sides of the HV device 30.

The cover 32 further comprises a raised edge 33, which runs along the side facing the interface junction between the connection block 20 and HV device 30. This raised edge 33 can be formed in the cover 32 at the time of stamping or forming.

Corresponding cover 21 of the connection block 20 is further defined as having an inverted channel comprising wall 22, transition portion 23, and downward oriented lip 24 which also runs along the side facing the interface junction between the connection block 20 and the HV device 30. this channel corresponds with and is designed to receive the raised edge 33 of cover 32, once installed after cover 32. This configuration provides a tortuous path through which any moisture or liquid contamination must traverse in order to penetrate the juncture between the connection block 20 and HV device 30 at interface 15.

The foregoing description of the embodiments has been provided for purposes of illustration and description. It is not intended to be exhaustive or to limit the invention. Individual elements or features of a particular embodiment are generally not limited to that particular embodiment, but, where applicable, are interchangeable and can be used in a selected embodiment, even if not specifically shown or described. Such variations are not to be regarded as a departure from the invention, and all such modifications are intended to be included within the scope of the invention. For the purpose of this disclosure, the term fastener can mean any type of fastener known in the art such as pins, screws, bolts or the like comprised of materials such as metals, alloys, polymers, or plastics known in the art.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the Figures. Spatially relative terms may be intended to encompass different orientations of the device in use or operation in addition to the orientation depicted in the Figures. For example, if the device in the Figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

What is claimed is:

1. A cover system for high voltage electric vehicle and hybrid electric vehicle applications comprising;

a high voltage connection block;

a high voltage device comprising a separate component from the high voltage connection block, but spaced from the connection block a predetermined distance and connected to the connection block by an interface, distal from a top opening of the high voltage connection block and a top opening of the high voltage device creating an exterior space between the interface and the top opening of the high voltage connection block and the top of the high voltage device, the high voltage device being selected from the list including a traction inverter, DCDC converter, and onboard charge module;

a first cover, for covering the top opening of the high voltage connection block;

a second cover for covering the top opening of the high voltage device, the second cover being relatively planar but having a raised edge along the side proximal the connection block, wherein the first cover partially overlaps the second cover raised edge and the exterior space when installed in a vehicle.

2. The cover system of claim 1, further defined wherein the second cover comprises a raised edge along the side proximal the connection block, the first cover overlapping the raised edge, and extending at least partially down the side of the raised edge distal from the connection block.

3. The cover system of claim 1, further defined wherein the second cover is prevented from being removed prior to the removal of the first cover.

4. The cover system of claim 2, further defined wherein the second cover is prevented from being removed prior to the removal of the first cover.

5. The cover system of claim 1, further defined wherein the interface between the first cover and the second cover prevents moisture from going between the connection block and the high voltage device.

6. The cover system of claim 2, further defined wherein the interface between the first cover and the second cover prevents moisture from going between the connection block and the high voltage device.

* * * * *